US007364621B2

(12) United States Patent
Defosse et al.

(10) Patent No.: US 7,364,621 B2
(45) Date of Patent: Apr. 29, 2008

(54) WATER FEED DEVICE FOR A MOISTENER OF A MAIL HANDLING MACHINE

(75) Inventors: Sébastien Defosse, Fontenay-aux-Roses (FR); Cédric Allibert, Meudon-la-Foret (FR)

(73) Assignee: Neopost Technologies, Bagneux (FR)

( * ) Notice: Subject to any disclaimer, the term of this patent is extended or adjusted under 35 U.S.C. 154(b) by 211 days.

(21) Appl. No.: 11/235,687

(22) Filed: Sep. 26, 2005

(65) Prior Publication Data

US 2006/0065191 A1 Mar. 30, 2006

(30) Foreign Application Priority Data

Sep. 27, 2004 (FR) ..... 04 10174

(51) Int. Cl.
*B05C 1/06* (2006.01)

(52) U.S. Cl. ..... 118/264; 118/267; 118/268; 156/441.5; 156/578

(58) Field of Classification Search ..... 118/264, 118/267, 268; 156/441.5, 578; 427/429
See application file for complete search history.

(56) References Cited

U.S. PATENT DOCUMENTS 1,889,911 A 12/1932 Storck
2,016,216 A 10/1935 Pike, Sr.
3,000,349 A * 9/1961 Ritzerfeld et al. ..... 118/264

FOREIGN PATENT DOCUMENTS

DE 86 13 332.2 8/1986
EP 0 631 885 A1 1/1995

* cited by examiner

*Primary Examiner*—Laura Edwards
(74) *Attorney, Agent, or Firm*—Sughrue Mion, PLLC

(57) ABSTRACT

A water feed device for feeding water to a moistener for moistening envelope flaps, which moistener is incorporated into a mail handling machine, the water feed device including a water tank which is mounted on a support and from which a quantity of water flows through a water feed pipe to a water reservoir in which part of a piece of foam is dipped, the quantity of water serving to impregnate the piece of foam for moistening the envelope flaps as they pass between a top surface of the piece of foam and a moistener brush, the water tank support being tilted at a determined angle β relative to a horizontal reference plane, and the water tank itself being tilted at a determined angle θ relative to the water tank support.

14 Claims, 2 Drawing Sheets

WATER FEED DEVICE FOR A MOISTENER OF A MAIL HANDLING MACHINE

CROSS-REFERENCE TO RELATED APPLICATIONS

This application claims priority from French Patent Application No. 04 10174, filed on Sep. 27, 2004.

TECHNICAL FIELD

The present invention relates exclusively to the field of mail handling and relates more particularly to a water feed device for a moistener for moistening envelope flaps and that is incorporated into a mail handling machine.

PRIOR ART

Devices making it possible to feed water to moisteners in mail handling machines are well known. FIG. 3 is a simplified section view of a typical example of such a device comprising a water tank 10 mounted on a support 12 and connected via a water feed pipe 14 to a water reservoir 16 which is disposed under a table 18 for conveying envelopes and in which part of piece of foam 20 is dipped. The envelopes are moistened as the flaps of said envelopes pass between the wet top surface of said piece of foam and a brush 22 placed immediately after a separator 24 serving to separate said flap from the body of the envelope.

That water feed device does not use any pumping means but nevertheless suffers from certain drawbacks. Firstly, it has been observed that on putting the water tank 10 in place, the water feed pipe 14 is full of air, and it is therefore necessary to expel said air on priming the device. Furthermore, when the piece of foam 20 is dry (when priming from dry), it is frequent that the water does not flow along the pipe 14 that takes it to the water reservoir 16. It has also be observed that air bubbles can be present, at the connection between the pipe and the water tank support, thereby reducing or even preventing flow, and naturally adversely affecting the quality of moistening.

OBJECTS AND DEFINITION OF THE INVENTION

The present invention thus proposes a water feed device that mitigates those drawbacks and that makes it possible in particular to prime from dry without any difficulty. An object of the invention is to provide such a device without significantly altering the current structure of mail handling machines.

These objects are achieved by a water feed device for feeding water to a moistener for moistening envelope flaps, which moistener is incorporated into a mail handling machine, the water feed device comprising a water tank which is mounted on a support and from which a quantity of water flows through a water feed pipe to a water reservoir in which part of a piece of foam is dipped, said quantity of water serving to impregnate said piece of foam for moistening said envelope flaps as they pass between a top surface of said piece of foam and a moistener brush, wherein said water tank support is tilted at a determined angle β relative to a horizontal reference plane, and said water tank is itself tilted at a determined angle θ relative to said water tank support.

Thus, with this particular configuration, putting the water tank in place no longer poses any particular problem, and the quantity of water deposited on the flap of the envelope is more uniform than in the prior art.

Advantageously, said angle of tilt β of said support lies in the range 5° to 8°, and is preferably 6.5°, and said angle of tilt θ of said water tank lies in the range 1.5° to 2.5°, and is preferably 20.

The angle of tilt 0 of the water tank is obtained by a back abutment on said support that tilts said water tank forwards about a finger of said support that serves to center said water tank on said support.

Preferably, said water tank has a bottom liquid level disposed at a determined height h above the level of a horizontal plane formed by said top surface of said piece of foam, and said height h lies in the range 0.4 millimeters (mm) to 0.6 mm, and is preferably 0.5 mm.

In a particular embodiment, at a connection to said water feed tube, said water tank support has an end-piece that is beveled over a determined length l that lies in the range 2.5 mm to 3.5 mm, and is preferably 3 mm.

The water feed pipe preferably has an end section that increases continuously in the direction in which air flows on priming, and a smooth inside wall.

BRIEF DESCRIPTION OF THE DRAWINGS

The characteristics and advantages of the present invention appear more clearly from the following description given by way of non-limiting indication, and with reference to the accompanying drawings, in which.

DETAILED DESCRIPTION OF A PREFERRED EMBODIMENT

Figure 1:
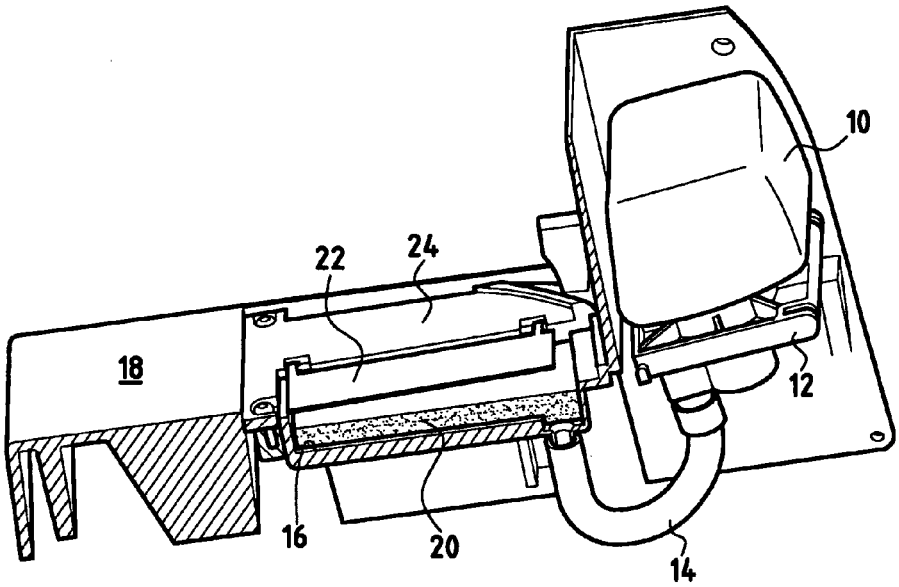
FIGS. 1 and 2 are views respectively in perspective and in cross-section of a water feed device of the invention for a moistener of a mail handling machine.
Figure 2:
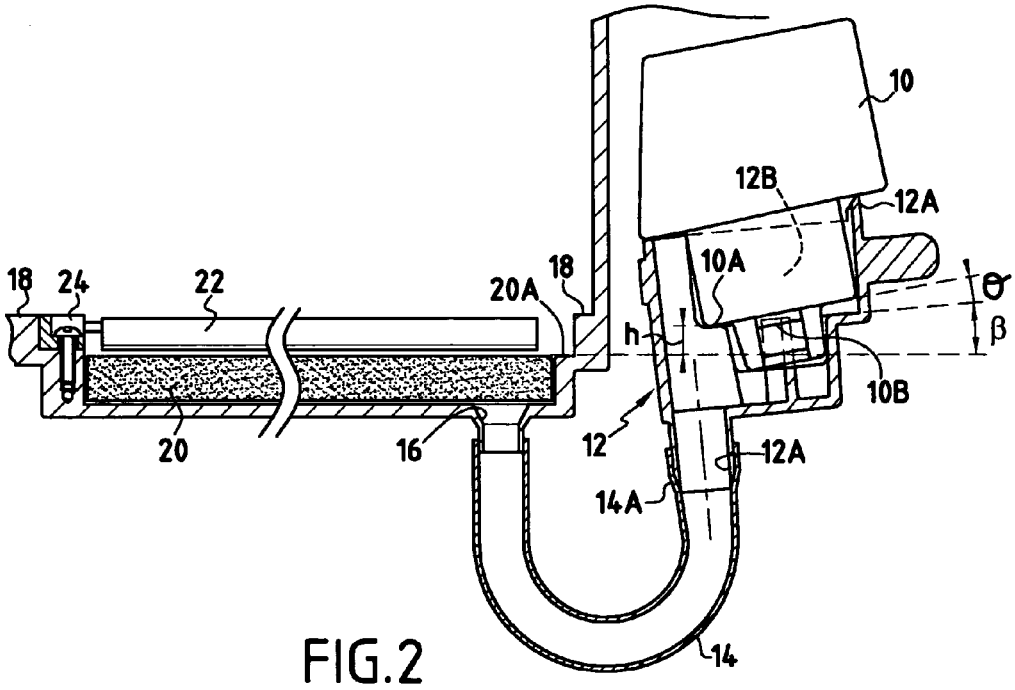
Figure 3:
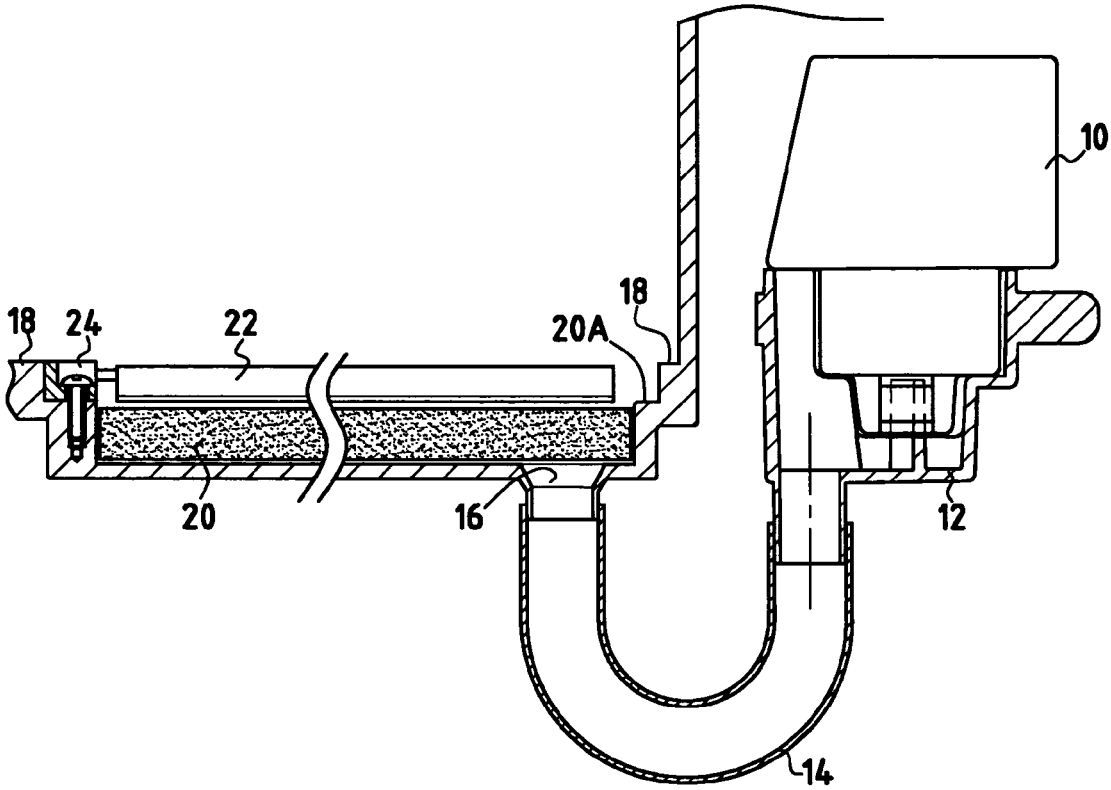
FIG.3 PRIOR ART
FIG. 3 is a view in cross-section of a prior art water feed device.

In accordance with the invention, FIGS. 1 and 2 are perspective and cross-section views of a feed device for feeding a moistening liquid to a moistener for moistening envelope flaps, which moistener is incorporated into a mail handling machine.

Like prior art feed devices, the feed device of the invention has a tank 10 of moistening liquid (preferably water), which tank is mounted on a support 12 and from which tank a quantity of moistening liquid flows through a feed pipe 14 to a liquid reservoir 16 which is disposed under the horizontal plane 18 forming a surface for supporting the envelopes as they are conveyed through the machine, and in which part of a piece of foam or sponge 20 is dipped, said quantity of moistening liquid serving to impregnate said piece of foam for moistening the flaps of envelopes passing between the top surface of said foam and a brush 22 hinged to the back (relative to the direction of advance of the envelopes) of a separator 24 serving to separate the flap of the envelope from the body of said envelope. Due to its configuration, the tank of moistening liquid is easily interchangeable.

However, in accordance with the invention, the water tank support is tilted towards the water reservoir 16 at an angle β relative to the plane of the floor on which the mail handling machine stands and thus also relative to the horizontal plane 18 forming the surface for supporting the envelopes that is parallel to said floor, and the water tank is itself tilted at an angle θ relative to said water tank support. The angle of tilt β lies in the range 5° to 8°, and is preferably equal to 6.5°, and the angle of tilt θ lies in the range 1.5° to 2.5°, and is preferably equal to 20 (these angles are deliberately exaggerated in FIG. 2 for better understanding of the invention).

This double tilted configuration firstly prevents an air bubble from being blocked at the outlet of the water tank when priming from dry, and secondly facilitates flow of water from said water tank. This results in increased flow speed, and above-all in a water level that is constant in the water tank 10.

The water tank is tilted merely by means of a back abutment 12A on the support that tilts said water tank forwards (i.e. towards the water reservoir 16) about a centering finger 12B incorporated in said support and serving to center said water tank on the support. Thus, air enters the water tank more easily, and thus improves water removal from said tank.

In addition, the water tank has a bottom liquid level 10A (corresponding to the inlet of a closure valve 10B for closing off the water tank) that is disposed at a height h above the level of a horizontal plane 20A forming the top surface of the piece of foam 20 as impregnated with water from the reservoir 16. Said height lies in the range 0.4 mm to 0.6 mm, and is preferably equal to 0.5 mm. With this configuration, water removal from the tank 10 is also facilitated. The speed of flow is improved accordingly.

Similarly, at a connection to said water feed pipe, the water tank support has an end-piece 12C that is beveled over a length l lying in the range 2.5 mm to 3.5 mm, and preferably equal to 3 mm, for an outside diameter of 10 mm and an inside diameter of 8 mm. The bevel on the end piece limits any blocking of air bubbles in said end-piece, in particular on priming, by improving the continuity of the surfaces of the inside diameters of the end-piece and of the pipe. The pipe also has an end section 14A that increases continuously in the direction in which air flows on priming. Thus, there is no snagging point that might retain an air bubble.

Preferably, a material having a smooth inside wall is chosen for the pipe so as to limit blocking of bubbles in the pipe and so as to improve the flow speed accordingly, and provision is made to increase the inside diameter of the pipe so that it no longer constitutes a limiting factor for the liquid flow rate.

What is claimed is:

1. A moistener device for moistening envelope flaps, in a mail handling machine, comprising:

a water tank, which is mounted on a support, for containing a quantity of water;

a water reservoir, in which a piece of foam is contained;

a water feed pipe connecting the water tank to the water reservoir to allow said quantity of water to flow from said water tank to the water reservoir, said water flow serving to impregnate said piece of foam for moistening said envelope flaps as the envelope flaps pass over a top surface of said piece of foam: and wherein said water tank support is tilted at a predetermined angle relative to a horizontal reference plane parallel to said top surface of said foam, and said water tank is itself tilted at a predetermined angle relative to said water tank support.

2. A moistener device according to claim 1, wherein said angle of tilt of said support lies in the range 5° to 8°.

3. A moistener device according to claim 1, wherein said angle of tilt of said water tank lies in the range 1.5° to 2.5°.

4. A moistener device according to claim 3, wherein said angle of tilt of the water tank is obtained by a back abutment on said support that tilts said water tank forwards about a finger of said support that serves to center said water tank on said support.

5. A moistener device according to claim 1, wherein said water tank has a bottom liquid level disposed at a determined height h above the level of a horizontal plane formed by said top surface of said piece of foam.

6. A moistener device according to claim 5, wherein said height h lies in the range 0.4 mm to 0.6 mm.

7. A moistener device according to claim 1, wherein, at a connection to said water feed pipe, said water tank support has an end-piece that is beveled over a determined length l.

8. A moistener device according to claim 7, wherein said length l lies in the range 2.5 mm to 3.5 mm.

9. A moistener device according to claim 1, wherein said water feed pipe has an end section that increases continuously in the direction in which air flows on priming.

10. A moistener device according to claim 9, wherein said feed pipe has a smooth inside wall.

11. A moistener device according to claim 1, wherein said angle of tilt of said water tank is preferably 6.5°.

12. A moistener device according to claim 1, wherein said angle of tilt of said water tank is 2°.

13. A moistener device according to claim 5, wherein said height h is 0.5 mm.

14. A moistener device according to claim 7, wherein said length l is 0.3 mm.

* * * * *